United States Patent [19]

Eriksson

[11] 4,383,766

[45] May 17, 1983

[54] BIN WITH PNEUMATIC AGITATOR PANEL

[76] Inventor: Hans E. Eriksson, Sjöviksvägen 21, S-144 00 Rönninge, Sweden

[21] Appl. No.: 290,112

[22] Filed: Aug. 5, 1981

[51] Int. Cl.[3] ..... B01F 11/00; B01F 13/02

[52] U.S. Cl. ..... 366/106; 222/203; 366/241

[58] Field of Search ..... 366/101, 106, 107, 241, 366/341, 255, 256; 222/203, 195; 406/138

[56] References Cited

U.S. PATENT DOCUMENTS

| | | | |
|---|---|---|---|
| 2,665,035 | 1/1954 | Schemm | 222/195 |
| 3,645,583 | 2/1972 | Heath | 222/195 |
| 3,653,639 | 4/1972 | Mueller | 366/106 |
| 3,669,317 | 6/1972 | Ivchenko | 222/195 |
| 3,862,707 | 1/1975 | Reiter | 366/101 |

*Primary Examiner*—Robert W. Jenkins

[57] ABSTRACT

In a bin for receiving pulverulent and similar slow-moving materials a pneumatic agitator panel is mounted to the bounding wall inside the bin and at its upper edge is secured to the bounding wall by means of a clamp rail extending along the upper edge and secured to the bounding wall.

1 Claim, 3 Drawing Figures

BIN WITH PNEUMATIC AGITATOR PANEL

BACKGROUND OF THE INVENTION

1. Field of the Invention

This invention relates to a bin for receiving pulverulent and similar slow-moving materials and more particularly to a bin of this type with a pneumatic agitator panel for agitating the material when the bin is to be emptied. The agitator is mounted to a bounding wall inside the bin and comprises a backing of sheet material and a covering of flexible material extending over one side of the backing and attached to the backing at the edges thereof. The covering faces the interior of the bin and is loose over a substantial part of the surface of said one side of the backing. A tube for the supply of pressurized air or other gas or gas mixture inbetween the backing and the covering is connected to the backing and opens at said one side thereof, said tube extending through the bounding wall to the outside of the bin. The agitator panel is attached to the bounding wall by securing means on the tube, engaging the bounding wall.

2. Description of the Prior Art

An agitator panel of the type referred is disclosed in the British Pat. No. 1 478 053. In this prior art panel the covering comprises a textile material permeable to the pressurized air or other gas or gas mixture which is supplied to the agitator from a pulsator so that the textile covering is oscillating in relation to the backing in the transverse direction thereof, the air at the same time being discharged through the textile covering into the bin to penetrate into the material received therein, the material being fluidized thereby so as to be discharged by flowing through a bottom outlet of the bin.

In practice, the prior art agitator panel is secured to the bounding wall of the bin by nuts engaging external threads of the tube, which are tightened against opposite sides of said wall. However, it has been found that after extended operation of the agitator panel the backing will break and the panel accordingly will be inoperative and useless for its intended purpose.

The invention is based on the observation that this failure of the agitator panel is due to the fact that the pulverulent material when fluidized by the pulsation effect, is brought to flow into a very tiny gap that may exist between the back side of the backing and the inside of the bounding wall, and will collect in this gap. The material thus collected will be compacted under the influence of the pulsating effect and thus will create a force between the backing of the agitator panel and the bounding wall of the bin, tending to successively increase the said gap, so that further amounts of material will be collected and compacted therein, which eventually leads to breakage of the backing.

The object of the invention is to eliminate the related failure of the agitator panel in a simple and inexpensive way.

Additional objects and advantages of the invention in part will be set forth in the description which follows and in part will be obvious from the description or may be learned by practice of the invention.

To achieve the foregoing objects and in accordance with the purpose of the invention as embodied and broadly described herein the invention provides in a bin with an agitator panel as referred to above, at least one clamp rail extending along at least part of an upper edge of the panel, and means securing the rail to the bounding wall of the bin with said rail abutting the agitator panel at the side thereof which is covered by the covering, to engage the agitator panel with said bounding wall.

Preferably one or more clamp rails abutting the agitator panel at the upper edge thereof, are secured to the bounding wall by screw connections.

The accompanying drawing which is incorporated in and constitutes a part of this specification, illustrates an embodiment of the invention and together with the description serves to explain the principles of the invention.

DESCRIPTION OF THE PREFERRED EMBODIMENT

Figure 1:
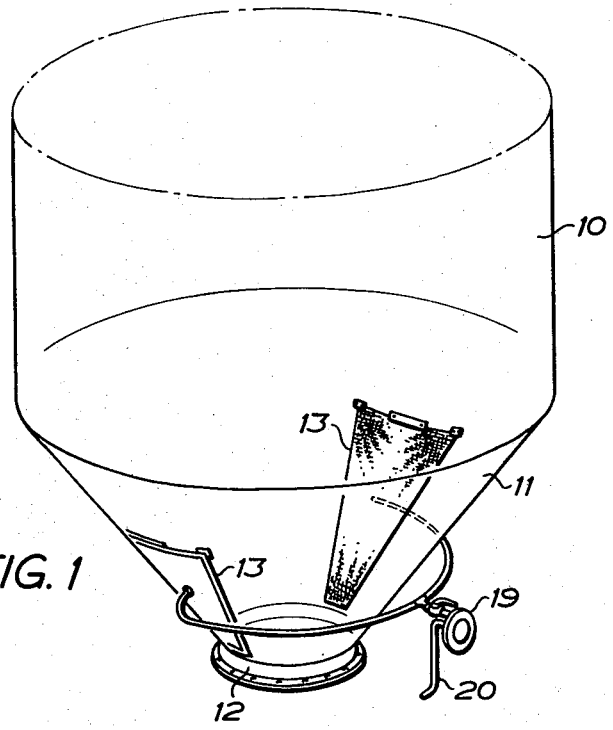
FIG. 1 is a transparent perspective view of a bin with pneumatic agitator panels arranged in accordance with the invention.
Figure 2:
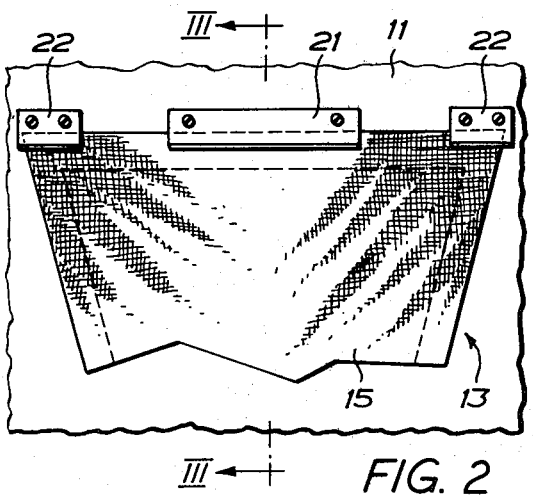
FIG. 2 is an enlarged fragmentary elevational view of one of the panels at the upper edge thereof as mounted in the bin.
Figure 3:
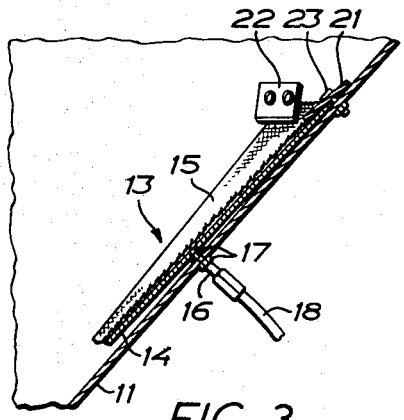
FIG. 3 is a fragmentary cross sectional view along line III—III in FIG. 2.

Referring now to the drawing it is shown in FIG. 1 therein cylindrical bin 10 having a conical lower end portion 11 with a central bottom outlet socket 12 to be connected to a discharge conduit for emptying the bin.

Two trapezoidal agitator panels 13 are mounted on the inside of the conical lower portion 11 at diametrically opposite locations adjacent the outlet socket 12. These agitator panels can be of the type described in the patent referred to above and each comprise a backing 14 which may be made of metal sheet material or a suitable plastic sheet material of such character that it can be deformed to a limited extent without breaking or cracking so as to follow the form of the curved bounding wall of the portion 11. On one side of the backing 14 there is mounted a covering 15 made of an air permeable fabric, the marginal portions of which are folded around the margins of the backing and are cemented to the opposite side of the backing. A tube 16 is mounted as by welding or brazing to the backing 14 in the central region thereof and opens inbetween the backing and the covering. The agitator panel composed by the backing and the covering is mounted to the bounding wall of the conical lower portion 11 of the bin by nuts 17 which engage external threads on the tube 16 and are tightened against opposite sides of the bounding wall. The tube 16 is connected by a conduit 18 to a pulsator 19 to which pressurized air or other gas or gas mixture is supplied through a conduit 20 so as to initiate an oscillating movement of the textile covering in the transverse direction of the backing, air pulses at the same time being transmitted from the agitator panel through the textile covering 15 to the interior of the bin to penetrate into the material received in the bin as is all well known in the art, in order to fluidize the material so that it can be discharged from the bin by flowing through the outlet socket 12.

At the upper edge of the agitator panel 13 this panel is clamped against the bounding wall of portion 11 by means of a central clamp rail 21 and two shorter end clamping rails 22 which abut the agitator panel at the side thereof which is provided with the covering 15 and are secured to the bounding wall of portion 11 by screw connections 23 comprising screws which extend through the clamping rail and the bounding wall, and nuts tightened against the outside of the bounding wall with a lock washer there between. Thus, it will be seen that the upper edge of the agitator panel is tightly engaged with the inner surface of the bounding wall so as to prevent pulverulent material received by the bin from penetrating between the agitator panel and the bounding wall.

Considering the fact that the bounding wall of the conical lower portion 11 is, it is preferred to arrange several separate clamp rails as shown herein, though it is also possible within the scope of the invention to have a single rail which extends continuously along the upper edge of the agitator panel.

The problem referred to above is encountered not only with agitators of the type having an air permeable covering but also with agitators wherein said covering is impermeable to air, and the invention accordingly includes agitator panels with a permeable as well as impermeable covering. As a further modification of the embodiment described it should be mentioned that the tube 16 for the supply of pressurized air may be located near one end of the panel and that an air outlet extending through the bounding wall of position 11 may be arranged near the opposite end of the panel.

It will be apparent to those skilled in the art that various other modifications and variations in addition to those mentioned above could be made in the agitator panel of the invention without departing from the scope and spirit of the invention.

I claim:

1. In a bin for receiving pulverulent and similar slow moving materials, a pneumatic agitator panel for agitating material in the bin, mounted to and extending over a portion only of a bounding wall inside the bin and comprising a sheet backing capable of being deformed to a limited extent without breaking or cracking; a covering of flexible material extending over the backing at one side thereof facing the interior of the bin and attached to the backing at the edges thereof, said covering being loose and free to pulsate over a substantial part of the surface of said one side of the backing; and pulsator means outside the bin for providing pulses of pressurized gas and a tube for supplying such pulses of pressurized air in between the backing and the covering, connected to the backing and opening at said one side thereof, so as to impart an oscillating movement to the covering, said tube extending through said bounding wall to the outside of the bin; securing means on said tube, engaging said bounding wall; at least one clamp rail extending along at least part of an upper edge of the agitator panel; and means securing the rail to said bounding wall with said rail abutting the panel at said one surface thereof to edge the panel with said bounding wall.

* * * * *